United States Patent [19]

Carter

[11] Patent Number: 4,891,848

[45] Date of Patent: Jan. 9, 1990

[54] WATERPROOF PILLOW

[76] Inventor: Tommy L. Carter, 230 E. Alvin Dr. #116, Salinas, Calif. 93906

[21] Appl. No.: 204,851

[22] Filed: Jun. 10, 1988

[51] Int. Cl.[4] ..... A47K 3/12

[52] U.S. Cl. ..... 4/571; 4/573; 4/575; 5/473

[58] Field of Search ..... 4/571, 575, 578, 579, 4/581, 582, 583, 573; 5/434, 442, 473

[56] References Cited

U.S. PATENT DOCUMENTS

| | | | |
|---|---|---|---|
| 2,093,964 | 9/1937 | Hindle | 4/575 |
| 2,483,077 | 9/1949 | Walsh | 4/575 |
| 2,674,752 | 4/1954 | Berman | 5/434 |
| 2,713,174 | 7/1955 | Merlin | 4/575 |
| 4,630,323 | 12/1986 | Sage et al. | 4/581 |

*Primary Examiner*—Henry J. Recla
*Assistant Examiner*—Glenn T. Barrett
*Attorney, Agent, or Firm*—Richard C. Litman

[57] ABSTRACT

There is disclosed an improved pillow assembly, especially designed for use when bathing. The assembly includes an independent head-shoulder support unit and an unattached independent body support unit. Both units are constructed of two layers of material, one being of an air entraining material and the other a suitable firm, rubberized material. The layers form a unit construction which is covered with a waterproof covering. The units are equipped with suction devices for securing them to surfaces. In use, the units provide support for the head and shoulders and also the body of a user in, for example, a bathtub.

3 Claims, 2 Drawing Sheets

WATERPROOF PILLOW

FIELD OF INVENTION

This device relates to bath accessories and, more particularly, to those accessories used for reclining in the tub to make the bath more comfortable.

BACKGROUND OF THE INVENTION

The present invention relates to those bath accessories or assemblies that make a bath more relaxing. Furthermore, this device serves to make the bath safer in utilizing means for affixing to the typically slippery bottom surface of a tub to thereby provide a foothold for a user entering or exiting the tub.

Further, this device relates to tub-pillows that enable the user to repose in the tub while at the same time support the back and shoulders.

This invention further relates to devices that adapt to the weight and physique of the user to make the bath much more comfortable.

SUMMARY OF THE PRIOR ART

The following cited references are found to be exemplary of the U.S. prior art. They are:

| U.S. Pat. No. | Inventor |
|---|---|
| 2,483,077 | Walsh |
| 4,051,563 | Clarke |
| 1,952,798 | Grandcourt |

U.S. Pat. No. 2,483,077, issued to Walsh, discloses a bath tub cushion that features a water proof casing, enclosing a seat cushion that is anchored by means of vacuum cups.

U.S. Pat. No. 4,051,563, to Clarke, teaches the construction of a cushioned liner that fits inside a bath tub, having a back cushion provided by a flexible water bag conforming to the back of the tub and left and right side cushions providing a flexible base to conform to the left and right sides of the tub.

U.S. Pat. No. 1,953,798, issued to Grandcourt, discloses a bath cushion that provides an upper resilient head pad portion and lower resilient neck pad member adapted to press gently against the muscular portion of the back of the neck to provide a gentle pressure and suitable support. This device is held in place by four suction cups attached to the back of the cushion.

While the prior art recites various pillow constructions none of them taken singly or in combination discloses the exact features and construction of the present invention.

SUMMARY OF THE INVENTION

A primary object of the present apparatus is to provide a tub-pillow apparatus that is both safe and comfortable to use. The device affixes to the bottom of the tub to secure the user's footing while entering and exiting the bath, and further provides increased comfort while the end user is reclined.

Another object is to provide head, shoulder and back support of a user, by having the apparatus adapt to the weight of the user, contouring and molding itself about the user, providing a maximum of support and comfort.

Moreover, an object of the present apparatus is to provide means for affixing the unit to a suitable surface for drying.

It is a further object of this invention to provide a construction for assisting a foam member therein to maintain its original shape.

These, together with other objects and advantages of the invention, reside in the details of the process and the operation thereof, as is more fully hereinafter described and claimed. References are made to drawings forming a part hereof, wherein like numerals refer to like parts throughout.

DESCRIPTION OF THE PREFERRED EMBODIMENT

Figure 1:
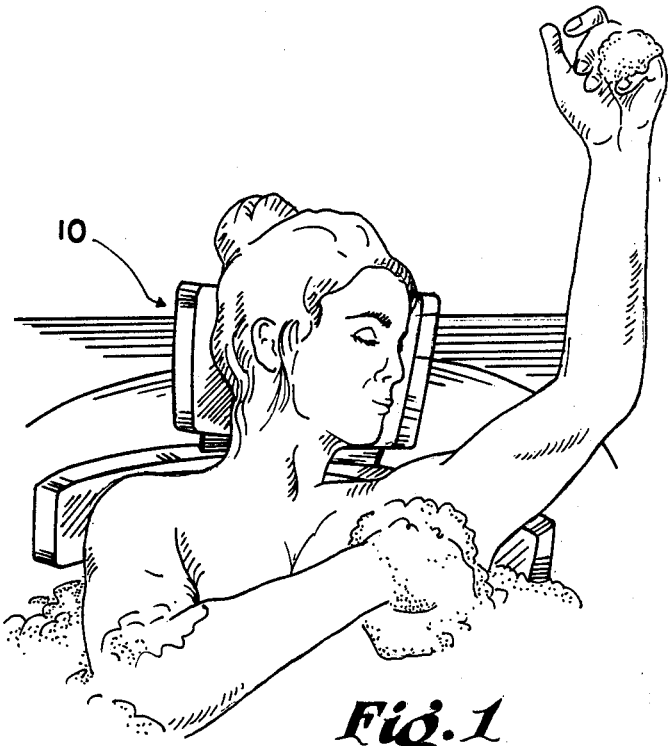
FIG. 1 is a perspective view of the upper portion of the device in its preferred embodiment.
Figure 2:
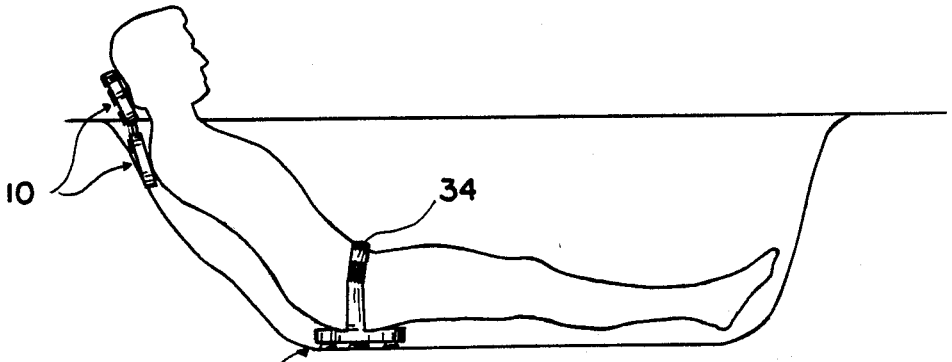
FIG. 2 is a profile or side view of the upper and bottom portions of this device.
Figure 3:
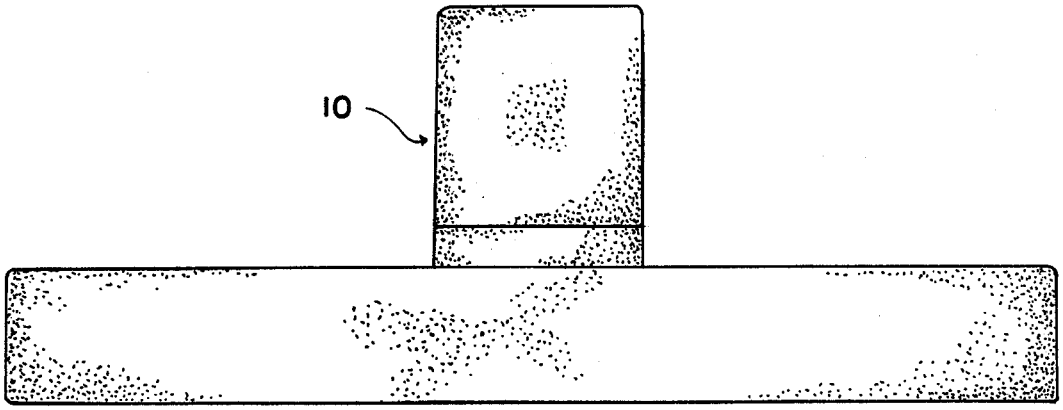
FIG. 3 is a front view of the upper portion of the device illustrating a head and shoulder support member.
Figure 7:
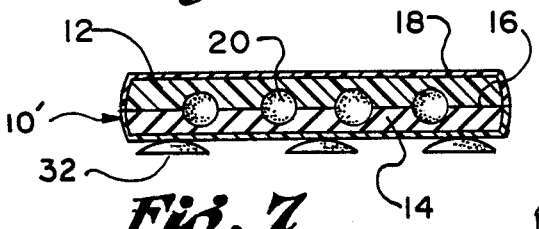
FIG. 7 is a section view of the lower portion of the device through 6—6 of FIG. 6.

Referring now to FIG. 7 of the drawings in which like numerals indicate like elements, device 10 includes a first layer of air entrapping material 12 that is affixed to and abutting a second layer of rubberized material 14. These two layers join or define a plane or boundary 16, as illustrated in FIG. 7, that is, substantially centered between the opposing layers of materials. This construction allows device 10 to be compressed in use as shown in FIGS. 1 and 2 and to maintain resiliency.

The first layer of material is any suitable air entraining material such as foam rubber sheeting. The second layer of material is any suitable firm, but pliable rubberized compound material.

Together, the first and second layers of material form a unit construction that is enclosed by a waterproof material covering 18. By enclosing the first and second layers of materials by waterproof covering 18 a single, unitary constuction is formed such that the physical properties of the cushion are a combination of the air entrained first layer and a more solid, firm rubberized second layer, providing thereby a construction that conforms to the user, while offering a firm degree of support.

A plurality of air cavities or pockets 20 are deployed therethrough and in the preferred embodiment, extend longitudinally, in substantially parallel fashion through layer 12 and through layer 14. Air passageways 20 are substantially deployed equally between the first and second layers of materials, and are provided to increase the percentage of entrapped or entrained air in the device such as the device is compressed, air is provided to assist the foam cells to again regain their original shape. The configuration and method of deployment of air cavities or pockets within the device also provide a plurality of flexion lines or points about which the remainder of the device may be folded to conform to the back, shoulder and back of the head of the user.

Deploying longitudinally extended air pockets, substantially as shown, provides the unit with a means for adapting to the user such that it enhances the relation of the user and the utility of the invention.

Figure 8:
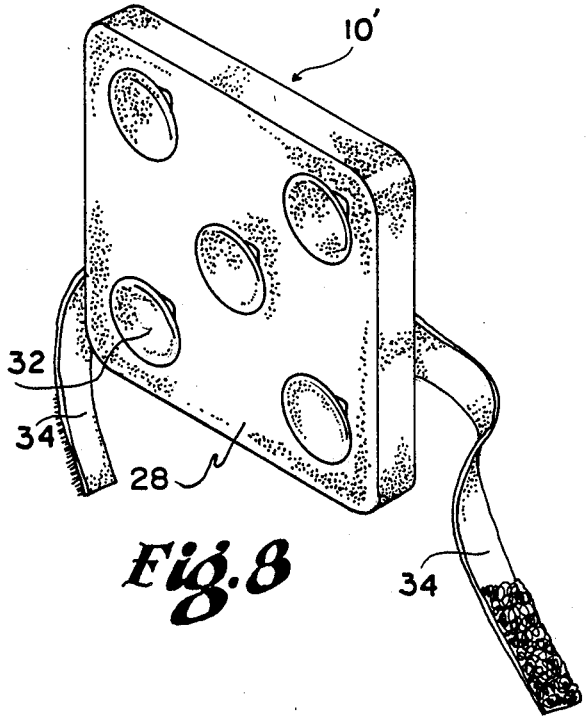
FIG. 8 illustrates a plurality of suction discs on the back of the lower portions of the devices for affixing it to an environmental surface, such as the inside bottom of the tub.
Figure 4:
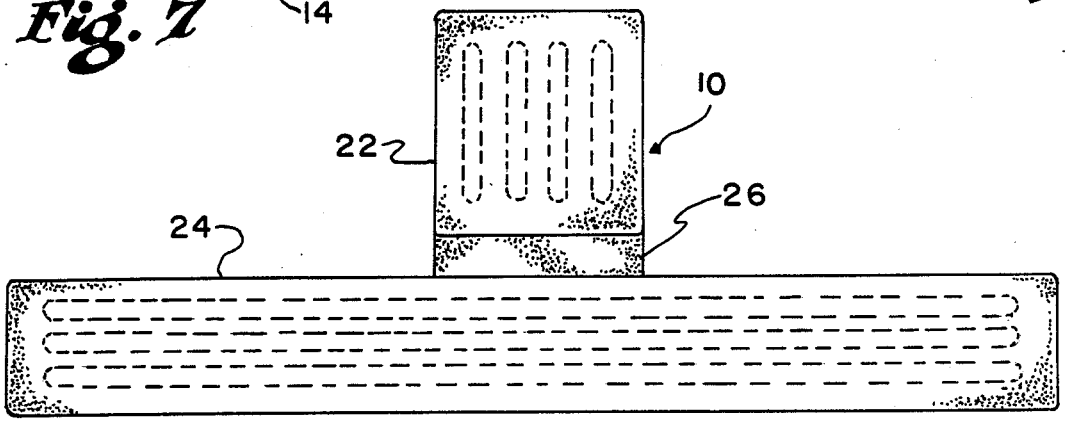
FIG. 4 is a view showing by hidden lines a plurality of air cavities or passageways built into the device.
Figure 5:
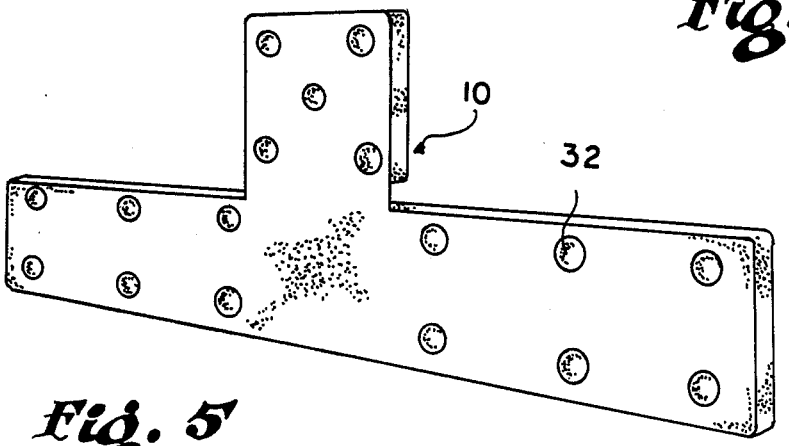
FIG. 5 illustrates a plurality of suction discs on the bottom of the device for affixing it to an environmental surface such as the bottom of the tub.

Head support portion 22 of head-shoulder support member 10 is sized and shaped, as illustrated in FIG. 4, to provide support for a user's head in a reclining position and likewise shoulder support portion 24 is of sufficient width and length to support of the shoulders and back. The two support portions are connected by a connection flap 26 that is made of any suitable pliable material to form an inverted T-shaped unit as shown in FIGS. 4 and 5. In addition to holding the two portions together, flap 26 permits the entire unit to fold at that point such that the head of the user may repose at any comfortable angle. Support cushion member 10' illustrated in FIGS. 2 and 8 is complementary to the head shoulder member and both are constructed identically.

All members have means for securing the device to the bottom surface of a tub, shower or hot tub or any suitable surfaces as may be appropriate. Such fastening means may comprise for example, a plurality of suction discs 32, as shown in FIGS. 5, 7, and 8 that are arrayed on the bottom of the respective members of the apparatus. In this manner, the members are affixed, both when supporting body portions or when a user enters and exits the bath.

Figure 6:
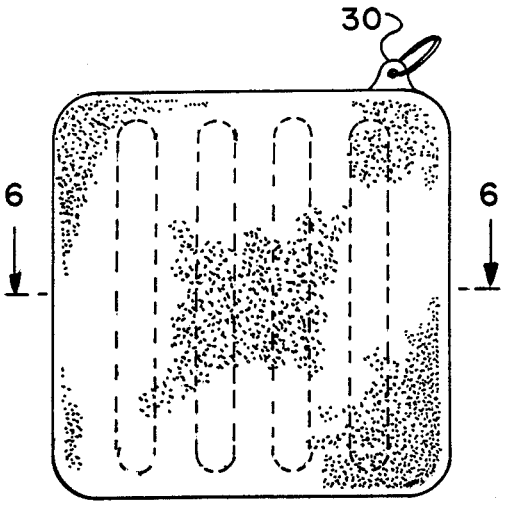
FIG. 6 is a front view of the lower portion of the device, showing by hidden line a plurality of air cavities or passageways built into the device.

The device has fastening means 30 for securing it to a wall other suitable surface for drying such as a hook and loop arrangement as indicated in FIG. 6; alternately, the hook and loop arrangement can be attached to the device shown in FIG. 4.

Additionally, straps 34 having hook and loop fasteners may be provided on either member to envelop the body of the user.

It will be apparent from the foregoing that the objects and advantages of the device have been disclosed and further, as many small changes will readily occur to those skilled in the art, it is understood that the scope of the invention includes all equivalents thereof, all such equivalents coming under the scope of the invention with the scope of invention being limited only by the claims.

What is claimed is:

1. A pillow assembly comprising an head-shoulder support member and a body support member separate and independent from said head-shoulder support member each comprising:

a first layer constructed of air entrained material;

a second layer constructed of a firm, pliable rubberized material;

said first and second layers being superimposed so that said first layer abuts said second layer defining a boundary substantially centered between said layers, said first and second layers having a plurality of air pockets disposed throughout;

said air pockets substantially equally deployed within said first and second layers;

a waterproof cover enclosing said first and second layers whereby said first and second layers define a floatable unit;

said head-shoulder support member having an uppermost portion sized and shaped to support a user's head and a lowermost portion of sufficient width and length to support a user's shoulders and back;

said uppermost and lowermost portions connected normally to each other to form an inverted T-shaped unit with the uppermost portion connected intermediate of the ends of the lowermost portion;

said independent head-shoulder and body support members each having means for adhering to an adjacent surface, whereby a user may recline thereon; and hook and loop fastener means attached to said body support member whereby said body support member may be affixed to the body of a user.

2. A pad assembly as recited in claim 1, wherein:

said adhering means comprises a plurality of suction devices arrayed such that said support members may be affixed through negative air pressure to any adjacent surface.

3. A pad assembly as recited in claim 1, wherein:

said air pockets are deployed substantially in longitudinal arrays therethrough substantially parallel with respect to each other.

* * * * *